United States Patent [19]

Boyadjieff

[11] 4,405,115

[45] Sep. 20, 1983

[54] GRIPPING JACK SYSTEM

[75] Inventor: George I. Boyadjieff, Anaheim, Calif.

[73] Assignee: Varco International, Inc., Orange, Calif.

[21] Appl. No.: 236,298

[22] Filed: Feb. 20, 1981

[51] Int. Cl.[3] ..... B66F 1/08

[52] U.S. Cl. ..... 254/106; 405/228

[58] Field of Search ..... 254/105–107, 254/89 H; 405/224–228, 232, 195–199; 175/5–9

[56] References Cited

U.S. PATENT DOCUMENTS

| | | | |
|---|---|---|---|
| 3,007,317 | 11/1961 | Suderow . | |
| 3,008,691 | 11/1961 | Steele et al. . | |
| 3,096,075 | 7/1963 | Brown | 254/106 |
| 3,495,806 | 2/1970 | Sutton . | |
| 3,598,369 | 8/1971 | Yielding | 254/106 |
| 3,804,369 | 4/1974 | Sutton . | |
| 3,889,926 | 6/1975 | Ahlgren | 254/106 |
| 4,030,698 | 6/1977 | Hansen | 254/106 |
| 4,367,056 | 1/1983 | Seneviratne | 254/106 |

FOREIGN PATENT DOCUMENTS 49-26840 1/1974 Japan .

*Primary Examiner*—Robert C. Watson
*Attorney, Agent, or Firm*—William P. Green

[57] ABSTRACT

A jack usable for leveling a marine platform jacket by lifting a tubular leg or pile guide relative to a pile extending upwardly therethrough includes a gripping unit having slips which engage and grip the pile and which in a predetermined elevated condition of the tubular member are engaged by that member and urged axially thereby in a grip tightening direction acting to positively lock the gripping unit against movement either upwardly or downwardly relative to the pile.

15 Claims, 7 Drawing Figures

GRIPPING JACK SYSTEM

BACKGROUND OF THE INVENTION

This invention relates to improved apparatus and methods for jacking two members axially relative to one another. Certain aspects of the invention are especially useful for leveling a marine platform jacket, and the invention will therefore be described primarily as applied to that use.

Marine platforms for off-shore well drilling and other similar uses are normally supported on a structure referred to as a 'jacket', forming a framework which projects downwardly into the water and rests on the sea bed. Piles are driven downwardly through tubular legs and/or tubular pile guides forming portions of the jacket, and into the earth formation beneath the water, to rigidly secure the jacket and platform in fixed positions. Grout is filled into spaces radially between the piles and the surrounding tubular portions of the jacket, and allowed to set, to lock the jacket against displacement relative to the piles. If the platform is not initially level when the jacket comes to rest on the sea bed, one side of the jacket may be jacked upwardly relative to the other side to level the platform before the grouting operation.

There is disclosed in copending U.S. patent application Ser. No. 06/227,735, now U.S. Pat. No. 4,367,056 entitled "Marine Platform Jacket Jack", filed Jan. 23, 1981 by Padmasiri D. Seneviratne a jacking mechanism which can be utilized for jacking a tubular leg or pile guide of a marine platform jacket upwardly relative to a pile extending through that tubular member to attain the above discussed platform leveling action. The jacking mechanism includes a gripping unit receivable about a pile or other member and preferably having tapered wedging slips which are cammed against the pile in a relation supporting the gripping unit against movement downwardly relative to the pile. Power actuated means desirably taking the form of piston and cylinder mechanisms are then operable to pull the tubular member about the pile upwardly relative to the gripping unit to thereby jack the platform to a proper level condition. In the arrangement of that prior application, the upward force is applied to the tubular member through a second slip-type gripping unit.

SUMMARY OF THE INVENTION

A purpose of the present invention is to provide improved jacking apparatus and methods utilizing at least one gripping unit of the above discussed general type, having a slip or slips for gripping the pile or other corresponding member, but in which the platform is more positively retained against even slight movement either upwardly or downwardly relative to the supporting piles during the substantial period of time required for setting of the grout, to thus assure optimum retention of the pile and surrounding tube in fixed relative positions by the grout. Slips of course normally act to restrain relative movement of two parts in only one axial direction, while permitting relative movement in the opposite direction. In a marine platform leveling operation, the weight of the platform jacket acts to apply a downward force on the pile engaging gripping unit, and the slips of that unit are designed to transmit force from the gripping unit to the pile in that downward direction. Wave action or other similar effects, however, may apply momentary reverse or upward forces to the jacket and platform on occasion, tending to shift the slips and gripping unit upwardly along the pile in a manner destroying the precisely level condition of the platform and tending to disrupt and displace the grout and adversely affect the connection formed thereby.

In order to prevent any such unwanted upward movement of the platform, and lock the tubular leg or pile guide against movement either upwardly or downwardly relative to the pile extending therethrough, a jacking mechanism constructed in accordance with the present invention is designed to cause the tubular member in the level condition of the platform to automatically apply a locking force to the slips of the pile engaging gripping unit, in a grip tightening direction, so that even if there are momentary upward forces exerted against the jacket and the tubular member the slips will not permit upward displacement of the tubular part, and the elements between which the grout is located will remain in fixed relative positions during the entire setting period of the grout. Desirably, the upper end of the tubular member moves directly into engagement with end faces of the slips, to apply the locking force to those slips.

While it is contemplated broadly that the attachment of the power cylinders of the jacking mechanism or other power actuated means to the tubular member may be made by connections of various types, the preferred arrangement is one in which a second slip type gripping unit is provided about the tubular member and acts to form the connection to that member. A locating sleeve may be received about the pile vertically between the two gripping units, and may be internally dimensioned to pass the tubular leg or pile guide of the platform jacket upwardly through that sleeve for actuating engagement with the slips of the upper gripping unit.

BRIEF DESCRIPTION OF THE DRAWINGS

The above and other features and objects of the invention will be better understood from the following detailed description of the typical embodiment illustrated in the accompanying drawing, in which.

DESCRIPTION OF THE PREFERRED EMBODIMENT

Figure 1:
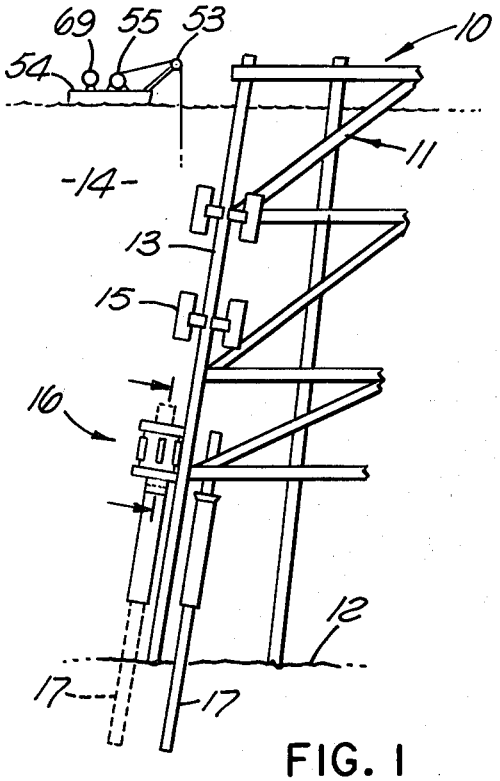
FIG. 1 is a representation of a marine platform jacket and a jacking device embodying the present invention positioned for use in leveling the platform.

FIG. 1 illustrates at 10 an off-shore well drilling platform which is intended to extend directly horizontally and is supported by a 'jacket' 11 forming a framework resting on the sea bed 12. Jacket 11 as illustrated includes a number of tubular legs 13 extending downwardly through the water to the sea bed and each of which may be formed of a series of large diameter pipe sections welded together in end to end relation. The piles for connecting the jacket to the earth formation beneath the body of water 14 may extend downwardly through legs 13 or may be driven downwardly through a series of pile guides such as those represented at 15. One or more jacking devices 16 constructed in accordance with the invention may be utilized in conjunction with piles driven downwardly through either legs 13 or guides 15 to raise one side of the jacket and platform slightly relative to the other in order to attain the desired precisely horizontal condition of the platform. In the drawings, it is typically assumed that the jacking device 16 is used in conjunction with one of several skirt piles 17 driven downwardly through one of a number of pile guides 15 secured rigidly to one of the jacket legs 13. As seen in FIG. 1, the legs and pile guides of the jacket are in most instances inclined to advance slightly laterally outwardly as they advance downwardly, in order to assure stability of the installed jacket and platform. For simplicity of illustration, however, FIGS. 2 through 7 do not attempt to illustrate this inclination of the legs, guides and piles, and the jacking tool, but instead show these elements in directly vertically extending positions.

Figure 4:
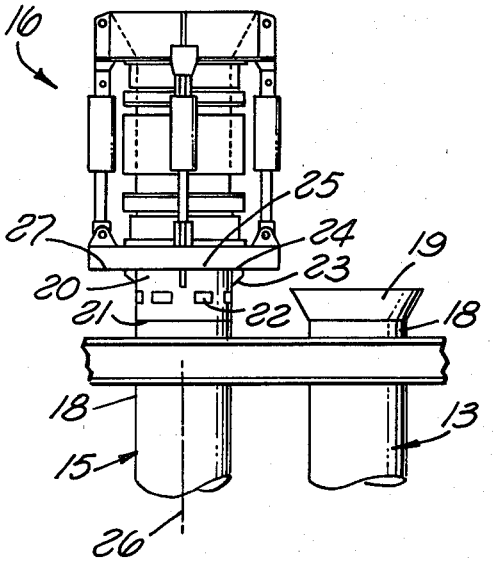
FIG. 4 illustrates the jack in the FIG. 3 condition as it appears in side elevation.

As seen in FIGS. 1 and 4, the pile guides 15 normally have main straight cylindrical portions 18 to the upper ends of which flaring bells or centering guides 19 are secured to direct a pile into centered relation within the guides. In a jacket which is to be leveled by a jacking mechanism of the present invention, one or more of the pile guides 15 near the lower end of the jacket may be formed without the usual centering bell 19, and in lieu of that bell have an extension sleeve 20 which projects upwardly above the main portion 18 of that guide and is annularly welded thereto at 21. This skirt sleeve extension 20 may be formed of a length of pipe of the same diameter as the main portion 18 of the guide, the pipe being internally and externally cylindrical and preferably having a number of circularly spaced openings 22 near its lower end through which excess grout may discharge. Above openings 22, the tubular sleeve 20 carries a number of circularly spaced support lugs 23, which may be welded to the outer surface of sleeve 20 and have upper surfaces 24 lying in a common plane 25 disposed transversely of the main longitudinal axis 26 of sleeve 20 and jack 16. Surfaces 24 of lugs 23 engage an annular undersurface 27 at the bottom of the jack mechanism disposed transversely of axis 26 to support the jack about sleeve 20 in the position shown in the drawings.

Figure 2:
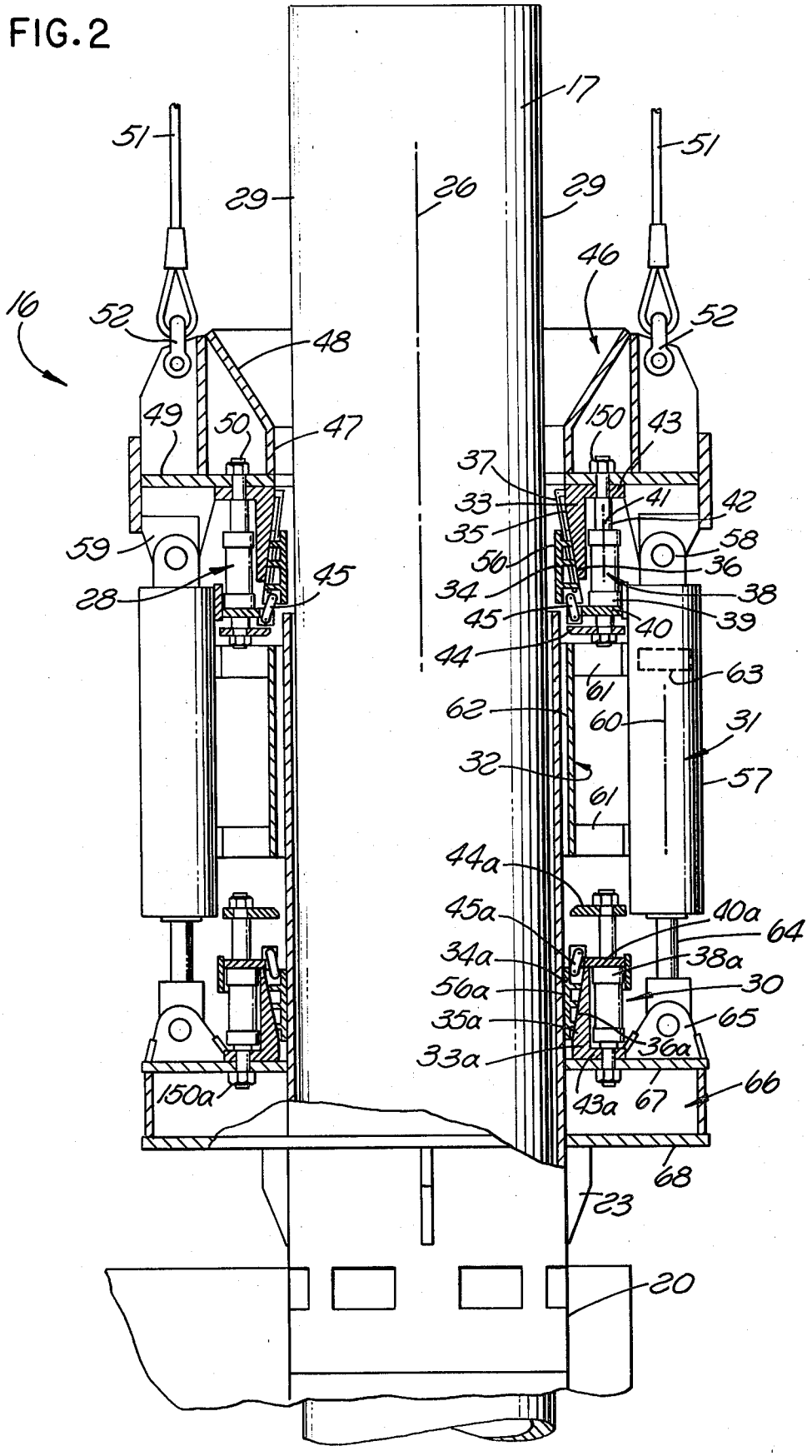
FIG. 2 is an enlarged axial section through the jack taken on line 2—2 of FIG. 1.

As seen best in FIG. 2, the jack 16 includes an upper gripping unit 28 which is adapted to engage and grip the outer cylindrical surface 29 of a pile 17 at a location above the upper end of sleeve 20, and includes also a second and lower gripping unit 30 adapted to be received about and grip the outer cylindrical surface of sleeve 20. Several piston and cylinder mechanisms 31 extend between these two gripping units and act to move them vertically relative to one another, and may be attached to a sleeve 32 vertically between units 28 and 30.

Upper gripping unit 28 includes an essentially annular rigid body 33 shaped to function as a slip bowl structure for engaging and locating a number of circularly spaced slips 34. At the location of each of the slips 34, body 33 has an upwardly conically tapering camming surface 35 engaging a correspondingly upwardly conically tapering camming surface 36 of the associated slip 34 to cam the slip radially inwardly against the outer surface 29 of the pile in response to upward movement of the slip relative to the slip bowl body 33. The slips may be appropriately retained in engagement with camming surfaces 35, and for upward and inward sliding movement relative thereto, by any conventional type of slip guiding structure typically illustrated as including a rod 37 rigidly secured to body 33 and inclined in correspondence with surfaces 35 and 36 and slidably received within guide openings in the slips. Slips 34 have inner gripping faces 56 which engage the outer cylindrical surface of pile 17 in the FIGS. 5 and 6 gripping positions of the slips, and which curve essentially cylindrically in correspondence with the pile surfaces and have gripping teeth acting to lock the slips aggainst either upward or downward movement relative to the pile in the FIGS. 5 and 6 condition.

Figure 6:
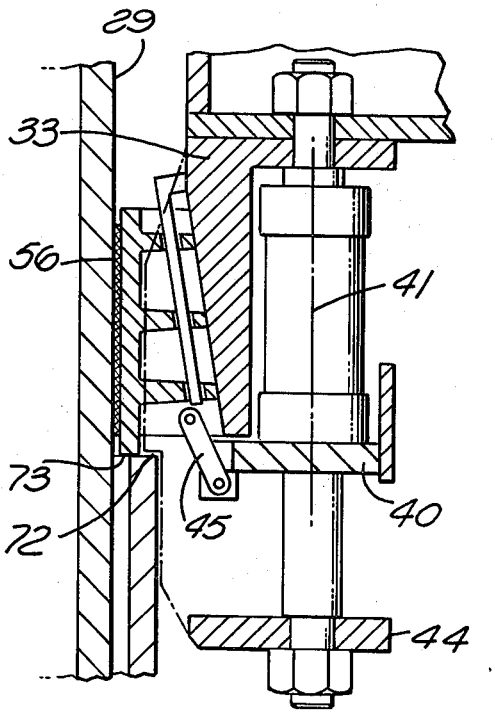
FIG. 6 is an enlarged axial section corresponding to a portion of FIG. 5.
Figure 7:
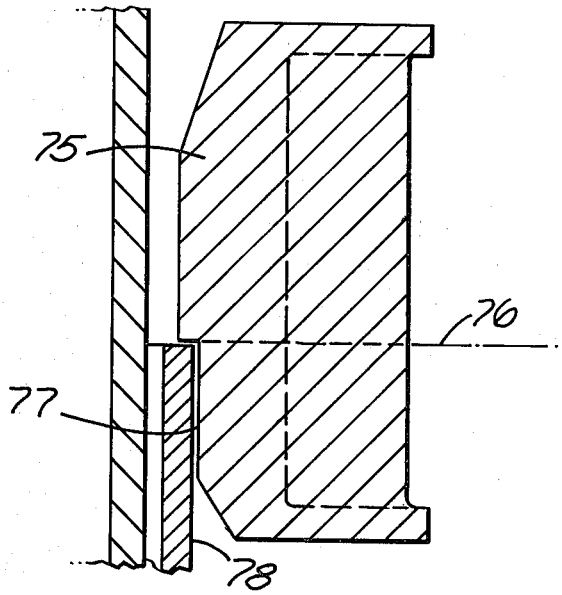
FIG. 7 is a fragmentary axial section taken at a location circularly between two of the slips of the upper gripping unit.

The slips are power actuable between their released non-gripping condition of FIG. 2 and their active gripping position of FIG. 6 by powered means controllable from the surface of the body of water within which the platform is located, and preferably including a number of circularly spaced piston and cylinder mechanisms 38, whose cylinders 39 may be connected to a slip actuating ring 40 centered about axis 26. The cylinders 39 are movable along individual axes 41 relative to the pistons of mechanisms 38, and the pistons 41 of mechanisms 38 may have double ended piston rods 42 rigidly connected at first ends to a flange 43 of body 33 and at second ends to a ring 44 of a diameter to be received about skirt sleeve extension 20. Ring 40 actuates the slips 34 through a number of links 45, which may be pivotally connected at their opposite ends to ring 40 and the slips to cause upward and downward movement of the slips in correspondence with upward and downward movement of ring 40 while permitting the slips to move radially inwardly and outwardly with respect to the ring as the slips move from their gripping positions to their retracted positions of FIG. 2. The rods 42 of the pistons of course extend along the different axes 41 to locate and guide cylinders 39 for movement along those axes.

Connected to the upper end of slip bowl body 33 of gripping unit 28, there is provided a pile centering guide or bell structure 46, having an internally straight cylindrical portion 47 of a diameter to be received closely about outer surface 29 of pile 17, and a portion 48 having an upwardly conically flaring annular inner surface engageable with a pile to direct its lower end into centered relation within jack 16. Guide structure 46 may have an annular wall 49 disposed transversely of axis 26 and welded to the other portions 47 and 48 of the structure, and appropriately rigidly secured to slip bowl body 33 as by extension of reduced diameter threaded end portions 50 of piston rods 42 through openings in wall 49 and flange 43 and connection of nuts 150 onto portions 50. Lines 51 for retrieving jack 16 after a platform leveling operation are connected to upper guide structure 46, as by means of shackles or other connectors 52 to which the lower ends of the lines may be secured. These lines may be suspended at their upper ends from a crane 53 mounted on a barge or other support vessel 54, with the lines being windable on a drum 55 to raise jack 16 to the surface after completion of a leveling operation.

The lower gripping unit 30 may be identical with the above discussed upper gripping unit 28, except that slips 34a in their gripping condition have a greater effective internal diameter than do slips 34, and are cammed to their gripping condition by downward rather than upward movement. The slip bowl structure or body 33a of the lower gripping unit has at the location of each of the slips 34a an inner camming surface 35a which tapers conically downwardly and engages a correspondingly downwardly conically tapering camming surface 36a of the associated slip. The inner gripping faces 56a of slips 34a curve essentially cylindrically about axis 26 at a diameter corresponding to the outer surface of sleeve 20, and have gripping teeth acting to support the weight of sleeve 20 and the jacket through the slips in the lower active positions of the slips relative to body 33a. Slips 34a are actuable by piston and cylinder mechanisms 38a corresponding to mechanisms 38 of the upper gripping unit and having their cylinders connected to a ring 40a attached to the slips by links 45a each pivoted at its opposite ends to the ring and one of the slips. The piston rods of mechanisms 38a are rigidly connected at their opposite ends to flange 43a of body 33a and a ring 44a. In the upper retracted position of ring 40a and the connected parts, slips 34a are withdrawn upwardly relative to body 33a and are retracted slightly radially outwardly away from engagement with the outer surface of sleeve 20 to allow upward and downward movement of gripping unit 30 relative to the sleeve.

The main piston and cylinder mechanisms 31 for applying the jacking force to the gripping units have their cylinders 57 connected at their upper ends 58 to brackets 59 projecting downwardly from the upper guide structure 46. There preferably are four of the piston and cylinder mechanisms 31, having their axes 60 disposed parallel to axis 26 and at evenly circularly spaced locations thereabout. The cylinders 57 may also be rigidly connected to sleeve 32, as by members 61 extending radially between sleeve 32 and the cylinders and appropriately welded or otherwise secured to these parts. Sleeve 32 has an inner cylindrical surface 62 which is a close fit about sleeve 20 and is preferably of a diameter approximately the same as the inner diameter of straight cylindrical portion 47 of guide structure 46.

The pistons 63 within cylinders 57 have their rods 64 connected at their lower ends to bracket lugs 65 formed on a rigid essentially annular lower body part 66. This lower body part 66 may be constructed of a number of parts rigidly welded together, and including top and bottom annular walls 67 and 68 joined by vertical connectors. The top wall 67 is rigidly secured to slip bowl body 33a of the lower gripping unit, as by connection of nuts 150a onto reduced diameter threaded end portions of the piston rods 42a of assemblies 38a.

The portions 75 of slip bowl 33 circularly between the slips have cylindrical centering surfaces 77 corresponding in diameter to the diameter of the external cylindrical surface 78 of sleeve 20 to accurately center sleeve 20 relative to the upper gripping unit.

When a jacking mechanism such as that shown at 16 is to be utilized for leveling a marine platform, it is preferred that the jack be moved into position about the tubular member 20 of FIG. 2 before the jacket is launched into the water. Before thus positioning the jack on tube 20, the slips 34 and 34a of both of the gripping units 28 and 30 are actuated to their released positions. With the jack in this condition, it is lowered to the position of FIG. 2 in which the lower body part 66 is supported on lugs 23 of sleeve 20, following which piston and cylinder mechanisms 38a of lower gripping unit 30 are actuated to move slips 34a downwardly from their retracted or inactive upper broken line positions of FIG. 2 to their lower full line active gripping positions in which they are capable of transmitting upward force from slip bowl body 33a to sleeve 20. With the jack thus positioned, and with the upper slips 34 still in their lower retracted positions, pile 17 is driven downwardly through jack 16 and through tube 20 and guide 15 into the sea bed to firmly anchor the pile relative to the sea bed. When the pile has been driven to a desired depth, the main piston and cylinder units 31 are actuated by fluid pressure to force their cylinders 57 and the connected parts including upper gripping unit 28 upwardly to a position such as that shown in FIGS. 3 and 4 and just far enough to enable the subsequent jacking operation as will be discussed to exactly level platform 10. The amount of upward movement of the upper gripping unit is indicated to an operator located in barge 54 on a remote indicator diagrammatically represented at 69 in FIG. 1. This indicator may be controlled by signals from a sensing unit diagrammatically represented at 70 in FIG. 3 as including an elongated rod 71 fixed to lower body 66 and movably engaging a coacting unit 71 carried by one of the cylinders 57. Unit 71 produces signals which may be conveyed in any appropriate manner to the indicator 69 to enable an operator by reference to indicator 69 to control precisely the amount upper gripping unit 28 is raised relative to lower gripping unit 30.

Figure 3:
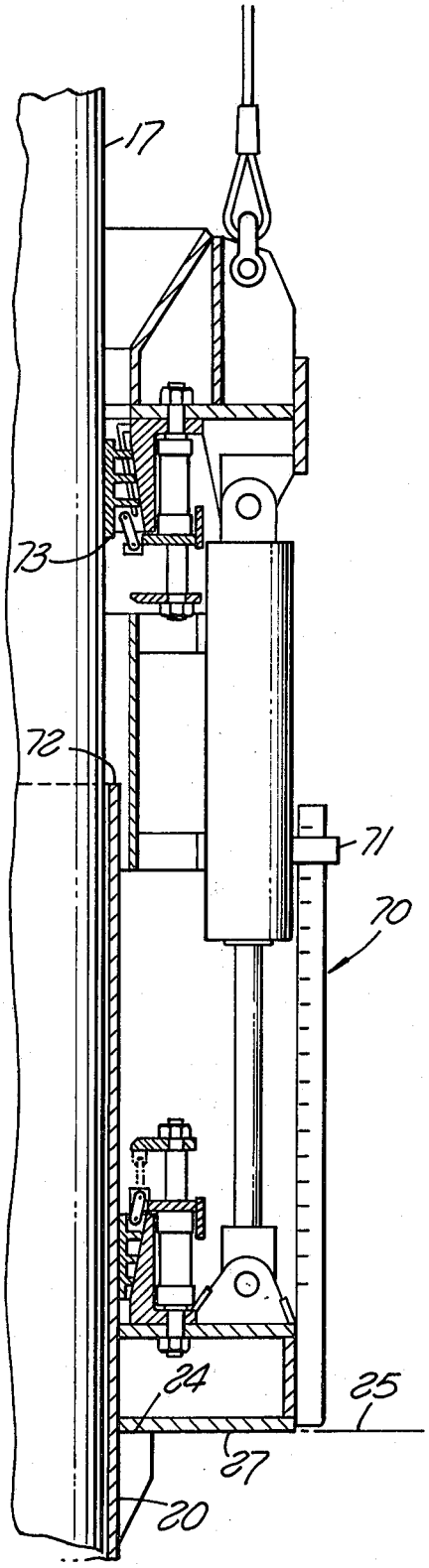
FIG. 3 is a fragmentary axial section through the jack as it appears after being extending axially preparatory to a lifting operation.
Figure 5:
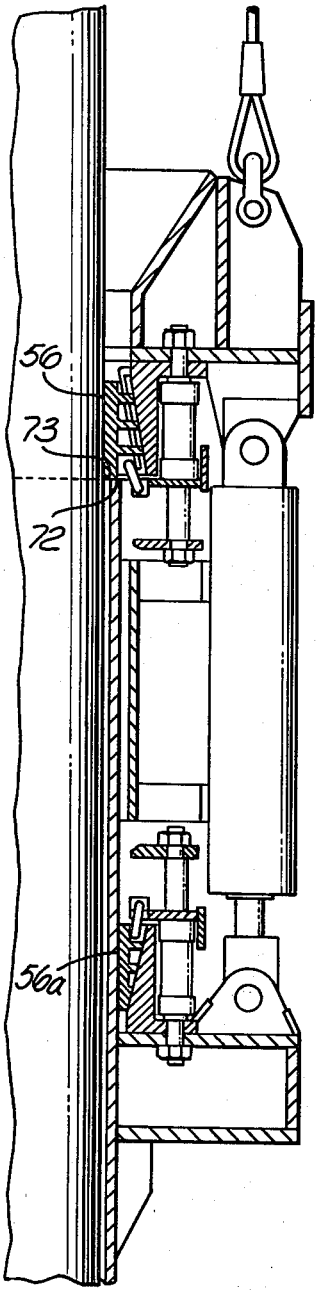
FIG. 5 is a view similar to FIGS. 2 and 3, but showing the jack after it has raised one side of the jacket and platform.

After the upper gripping unit has thus been elevated along the pile to the desired FIG. 3 and FIG. 4 position, the piston and cylinder machanisms 38 of upper gripping unit 28 are actuated to move slips 34 upwardly to their active gripping positions of engagement with pile 17. With the slips of both gripping units held in their active gripping conditions, piston and cylinder mechanisms 31 are actuated to pull lower body part 66 and lower gripping unit 30 upwardly relative to upper gripping unit 28, to thus forcibly elevate tubular part 20 and the remainder of the jacket and platform structure relative to the pile. This upward movement, represented in FIG. 5, is continued until the upper annular transverse end edge 72 engages downwardly facing surfaces 73 on slips 34 to exert upward force against the slips. This engagement of the slips with tubular member 20 places that sleeve 20 and the slips and piston and cylinder mechanisms 31 in a heavily preloaded condition, preferably approximately a one-thousand ton preload very effectively retaining slips 34 against any possible downward movement relative to the engaged slip bowl structure 33, and thus effectively locking the upper gripping unit against either upward or downward movement relative to the pile.

Because of the predetermination of the extent to which the upper gripping unit is moved upwardly relative to the lower gripping unit in the FIGS. 3 and 4 condition of the apparatus, the platform 10 is exactly horizontal in the FIG. 5 locked preloaded condition of the equipment.

With the platform held in this precisely horizontal condition and with the jack preloaded as discussed, grout is filled into the annular space radially between the outer surface of pile 17 and the inner surface of tubular pile guide 15, with excess grout discharging through bottom openings 22 in sleeve 20, and the apparatus is held in this condition while the grout sets. After the grout has hardened and set completely, the operator on barge 54 can reverse the pressure in piston and cylinder mechanisms 38 and 31 to release the upper gripping unit and raise the upper gripping unit relative to the lower gripping unit, and then similarly reverse the pressure in the cylinders of the lower gripping unit to release the bottom slips. The entire jack 16 can then be withdrawn upwardly by lines 51 from about the pile guide and pile, and retrieved onto barge 54 for subsequent use in leveling another platform.

While a certain specific embodiment of the present invention has been disclosed as typical, the invention is of course not limited to this particular form, but rather is applicable broadly to all such variations as fall within the scope of the appended claims.

I claim:

1. The combination comprising first and second members, and jacking mechanism for moving said members along an axis relative to one another, said jacking mechanism comprising:

two structures which are relatively axially movable and transmit force in opposite directions to said two members respectively; and power operated means for moving said two structures axially relative to one another and thereby jacking said two members axially relative to one another;

one of said structures including a slip bowl adapted to be urged axially by said power actuated means, and at least one slip engaging said bowl in a relation to be cammed thereby against said first member in gripping relation;

said second member having a portion extending to a location at which it can apply axial force to said slip in a grip tightening direction upon relative axial actuation of said members by said power operated means.

2. The combination as recited in claim 1, in which the other of said structures includes a second slip bowl and at least one slip engageable therewith and cammed thereby against said second member in gripping relation.

3. The combination as recited in claim 1, in which the other of said structures includes a second slip bowl and at least one slip adapted to be cammed thereby against the second of said members in gripping relation, said two structures engaging and gripping said members at different diameters, with said second member disposed about said first member.

4. The combination comprising a generally vertically extending tubular outer member, an inner support member extending upwardly through said outer member, and jacking mechanism for lifting said outer member relative to said inner member, said jacking mechanism comprising:

a gripping unit extending about said inner member at a location above said tubular outer member and including a slip bowl structure, slips adapted to be cammed inwardly by said bowl structure to grip said inner member at a first diameter and thereby support the gripping unit from said inner member, and means for actuating said slips relative to said bowl structure between upper gripping positions and lower released positions; and power operated means supported by said gripping unit and connected to said tubular outer member for exertion of upward force thereagainst to jack said tubular member upwardly relative to the gripping unit and inner member;

said tubular outer member extending upwardly to a location at which it can apply force to said slips in an upward grip tightening direction in response to upward movement of said tubular member relative to said inner member by said power operated means.

5. The combination recited in claim 4, in which said jacking mechanism includes a second gripping unit urged upwardly by said power operated means relative to said first gripping unit and having a slip bowl and slips adapted to be cammed thereby against said tubular outer member to apply upward force thereto.

6. The combination recited in claim 4, in which said jacking mechanism includes a second gripping unit extending about said tubular outer member beneath said first gripping unit, and stop means for limiting downward movement of said second gripping unit relative to said tubular member.

7. The combination recited in claim 4, including a sleeve received about said tubular outer member and through which said tubular member extends upwardly for application of upward force to said slips.

8. The combination recited in claim 7, in which said power operated means include piston and cylinder means attached to said sleeve.

9. Jacking mechanism for lifting a generally vertically extending tubular outer member relative to an inner support member extending upwardly therethrough, comprising:

a gripping unit adapted to extend about said inner member at a location above said tubular outer member and including a slip bowl structure, slips adapted to be cammed inwardly by said bowl structure to grip said inner member at a first diameter and thereby support the gripping unit from said inner member, and means for actuating said slips relative to said bowl structure between upper gripping positions and lower released positions;

power operated means supported by said gripping unit and adapted to be connected to said tubular outer member for exertion of upward force thereagainst to jack said tubular member upwardly relative to the gripping unit and inner member;

said jacking mechanism being open to extension of said tubular outer member upwardly, at a diameter greater than said first diameter, to a location at which said tubular outer member can apply force to said slips in an upward grip tightening direction in response to upward movement of said tubular member relative to the inner member by said power operated means; and a sleeve to be received about said members and having an internal diameter substantially greater than said first diameter at which said slips grip said inner member to allow extension of said tubular member upwardly radially between said sleeve and said inner member for tightening said slips.

10. Jacking mechanism as recited in claim 9, in which said power operated means include piston and cylinder means attached to said sleeve.

11. Jacking mechanism as recited in claim 9, in which said slips have downwardly facing surfaces engageable by an upper end of said tubular outer member to urge the slip means upwardly in a tightening direction.

12. Jacking mechanism as recited in claim 9, including a second gripping unit urged upwardly by said power operated means relative to said first gripping unit and having a slip bowl and slips adapted to be cammed thereby against said tubular outer member to apply upward force thereto.

13. Jacking mechanism as recited in claim 9, including a second gripping unit adapted to extend about said tubular outer member beneath said first gripping unit, and stop means for limiting downward movement of said second gripping unit relative to said tubular member.

14. Jacking mechanism for elevating a tubular outer member relative to an inner member extending upwardly therethrough, comprising:

a first gripping unit to be received about said inner member at a location above said tubular outer member and including an upwardly tapering slip bowl structure, slips having gripping faces adapted to engage and grip said inner member at a first diameter and having upwardly tapering camming surfaces engageable with said bowl structure to cam the slips into gripping engagement with said inner member in response to application of downward force against said bowl structure, and means for actuating said slips relative to the slip bowl structure between upper gripping positions and lower released positions;

a second gripping unit adapted to be received about said tubular outer member and including a downwardly tapering slip bowl structure, slips having gripping faces for engaging and gripping said tubular outer member at a second diameter greater than said first diameter and having downwardly tapering camming surfaces acting to urge the slips into tight gripping engagement with said tubular outer member in response to exertion of upward force against said slip bowl structure of the second gripping unit, and means for actuating said slips of the second gripping unit between lower gripping positions and upper retracted positions;

power operated means for moving said second gripping unit upwardly relative to said first gripping unit to raise said tubular outer member relative to said inner member;

said jacking mechanism being open to extension of said tubular outer member upwardly to a location at which said tubular outer member can apply upward force to said slips of the first gripping unit in a relation tightening the grip of said slips on said inner member in response to upward actuation of said tubular member by said power operated means; and a sleeve to be received about said outer tubular member at a location axially between said two gripping units and having an internal diameter great enough to pass said tubular member upwardly through the sleeve and to a position for exertion of upward grip tightening force against said slips of the first gripping unit.

15. Jacking mechanism as recited in claim 14, in which said power operated means include fluid pressure operated piston and cylinder means acting downwardly against said slip bowl structure of the first gripping unit and upwardly against the slip bowl structure of said second gripping unit.

* * * * *